US011525640B2

(12) United States Patent
Shoele et al.

(10) Patent No.: US 11,525,640 B2
(45) Date of Patent: Dec. 13, 2022

(54) ACTIVE VORTEX GENERATOR TO IMPROVE HEAT TRANSFER IN HEAT EXCHANGERS

(71) Applicant: The Florida State University Research Foundation, Inc., Tallahassee, FL (US)

(72) Inventors: Kourosh Shoele, Tallahassee, FL (US); Mehdi Vahab, Tallahassee, FL (US)

(73) Assignee: The Florida State University Research Foundation, Inc., Tallahassee, FL (US)

( * ) Notice: Subject to any disclaimer, the term of this patent is extended or adjusted under 35 U.S.C. 154(b) by 123 days.

(21) Appl. No.: 16/782,117

(22) Filed: Feb. 5, 2020

(65) Prior Publication Data

US 2020/0263939 A1 Aug. 20, 2020

Related U.S. Application Data

(60) Provisional application No. 62/805,491, filed on Feb. 14, 2019.

(51) Int. Cl.
*F28F 13/12* (2006.01)

(52) U.S. Cl.
CPC ..... *F28F 13/125* (2013.01)

(58) Field of Classification Search
CPC ..... F28F 13/02; F28F 13/125; F04D 33/00
See application file for complete search history.

(56) References Cited

U.S. PATENT DOCUMENTS

2003/0043531 A1* 3/2003 Trautman ..... G06F 1/20 361/274.3
2004/0207292 A1* 10/2004 Scher ..... H01L 41/0993 310/328
2012/0006511 A1* 1/2012 Kaslusky ..... F28F 13/12 165/109.1

(Continued)

OTHER PUBLICATIONS

Ahn, H., and Son, G., "Numerical simulation of liquid film evaporation in circular and square microcavities," Numerical Heat Transfer, Part A: Applications, vol. 67, No. 9, 2015, pp. 934-951.

(Continued)

*Primary Examiner* — Eric S Ruppert
(74) *Attorney, Agent, or Firm* — Meunier Carlin & Curfman LLC

(57) ABSTRACT

An active vortex generator adapts to a flow rate of fluid through and/or a heat flux applied through a heat exchanger channel to improve the heat transfer rate of the heat exchanger. In some implementations, the movement of the active vortex generator may be induced by the fluid flow through the heat exchanger channel. In some implementations, the movement of the active vortex generator may be induced through an externally applied force on the active vortex generator. An actuated active vortex generator is particularly suited to heat exchangers with high heat flux dissipation requirements. Locating an actuated active vortex generator proximate to such high heat flux dissipation locations provides for improved heat transfer that can be activated when needed, such as upon operation of a high heat flux component.

20 Claims, 13 Drawing Sheets

(56) References Cited

U.S. PATENT DOCUMENTS

2015/0285270 A1* 10/2015 Buckland ..... F04D 33/00
92/67

OTHER PUBLICATIONS

Bauerecker, S., Ulbig, P., Buch, V., Vrbka, L., and Jungwirth, P., "Monitoring ice nucleation in pure and salty water via high-speed imaging and computer simulations," The Journal of Physical Chemistry C, vol. 112, No. 20, 2008, pp. 7631-7636.
Bonhomme, R., Magnaudet, J., Duval, F., and Piar, B., "Inertial dynamics of air bubbles crossing a horizontal fluid-fluid interface," Journal of Fluid Mechanics, vol. 707, 2012, pp. 405-443.
Brackbill, J., Kothe, D. B., and Zemach, C., "A continuum method for modeling surface tension," Journal of computational physics, vol. 100, No. 2, 1992, p. 335-354.
Cocchi, J.-P., and Saurel, R., "A Riemann problem based method for the resolution of compressible multimaterial flows," Journal of Computational Physics, vol. 137, No. 2, 1997, pp. 265-298.
Davis, S. H., Theory of solidification, Cambridge University Press, 2001. Chapter 2, Pure Substances, 7-41.
De Gennes, P.-G., Brochard-Wyart, F., and Quéré, D., Capillarity and wetting phenomena: drops, bubbles, pearls, waves, Springer Science & Business Media, 2013.
Dhir, V. K., "Numerical simulations of pool-boiling heat transfer," AIChE Journal, vol. 47, No. 4, 2001, pp. 813-834.
Dutil, Y., Rousse, D. R., Salah, N. B., Lassue, S., and Zalewski, L., "A review on phase-change materials: mathematical modeling and simulations," Renewable and sustainable Energy reviews, vol. 15, No. 1, 2011, pp. 112-130.
Francois, M., Shashkov, M., Masser, T., and Dendy, E., "A comparative study of multimaterial Lagrangian and Eulerian methods with pressure relaxation," Computers & Fluids, vol. 83, 2013, pp. 126-136.
Francois, M.M., Cummins, S. J., Dendy, E. D., Kothe, D. B., Sicilian, J.M., and Williams, M.W., "A balanced-force algorithm for continuous and sharp interfacial surface tension models within a volume tracking framework," Journal of Computational Physics, vol. 213, No. 1, 2006, pp. 141-173.
Gibou, F., Chen, L., Nguyen, D., and Banerjee, S., "A level set based sharp interface method for the multiphase incompressible Navier-Stokes equations with phase change," Journal of Computational Physics, vol. 222, No. 2, 2007, pp. 536-555.
Goldstein, D., Handler, R., and Sirovich, L., "Modeling a no-slip flow boundary with an external force field," Journal of Computational Physics, vol. 105, No. 2, 1993, p. 354-366.
Goza, A., and Colonius, T., "A strongly-coupled immersed-boundary formulation for thin elastic structures," Journal of Computational Physics, vol. 336, 2017, pp. 401-411.
Huang, W.-X., Shin, S. J., and Sung, H. J., "Simulation of flexible filaments in a uniform flow by the immersed boundary method," Journal of Computational Physics, vol. 226, No. 2, 2007, pp. 2206-2228.
Ishii, M., and Hibiki, T., Thermo-fluid dynamics of two-phase flow, Springer Science & Business Media, 2010, 44 pages.
Jacobi, A., and Shah, R., "Heat transfer surface enhancement through the use of longitudinal vortices: a review of recent progress," Experimental Thermal and Fluid Science, vol. 11, No. 3, 1995, pp. 295-309.
Kays, W., and Crawford, M., Convective heat and mass transfer, McGraw Hill, New York., 1993.Chapter 8, Momentum Transfer: The Laminar External Boundary Layer, 88-107.
Kays, W., and Crawford, M., Convective heat and mass transfer, McGraw Hill, New York., 1993.Chapter 10, Heat Transfer: The Laminar External Boundary Layer, 159-191.
Lai, M.-C., and Peskin, C. S., "An immersed boundary method with formal second-order accuracy and reduced numerical viscosity," Journal of computational Physics, vol. 160, No. 2, 2000, pp. 705-719.
Lee, I., and Choi, H., "A discrete-forcing immersed boundary method for the fluid-structure interaction of an elastic slender body," Journal of Computational Physics, vol. 280, 2015, pp. 529-546.
Lepilliez, M., Popescu, E. R., Gibou, F., and Tanguy, S., "On two-phase flow solvers in irregular domains with contact line," Journal of Computational Physics, vol. 321, 2016, pp. 1217-1251.
Li, G., Lian, Y., Guo, Y., Jemison, M., Sussman, M., Helms, T., and Arienti, M., "Incompressible multiphase flow and encapsulation simulations using themoment-of-fluid method," International Journal for NumericalMethods in Fluids, vol. 79, No. 9, 2015, pp. 456-490.
Lian, Y., Liao, D., Qiu, H., Sussman, M., Vahab, M., and Hussaini, Y., "Experimental and Numerical Investigation of Icing Process of a Liquid Droplet," 9th AIAA Atmospheric and Space Environments Conference, 2017, p. 4481.
Lotfi, B., Zeng, M., Sundén, B., and Wang, Q., "3D numerical investigation of flow and heat transfer characteristics in smooth wavy fin-and-elliptical tube heat exchangers using new type vortex generators," Energy, vol. 73, 2014, pp. 233-257.
Luo, H., Baum, J. D., and Löhner, R., "On the computation of multi-material flows using ALE formulation," Journal of Computational Physics, vol. 194, No. 1, 2004, pp. 304-328.
Oberli, L., Caruso, D., Hall, C., Fabretto, M., Murphy, P. J., and Evans, D., "Condensation and freezing of droplets on superhydrophobic surfaces," Advances in colloid and interface science, vol. 210, 2014, pp. 47-57.
Scardovelli, R., and Zaleski, S., "Direct numerical simulation of free-surface and interfacial flow," Annual review of fluid mechanics, vol. 31, No. 1, 1999, pp. 567-603.
Shin, S. J., Huang, W.-X., and Sung, H. J., "Assessment of regularized delta functions and feedback forcing schemes for an immersed boundary method," International Journal for Numerical Methods in Fluids, vol. 58, No. 3, 2008, pp. 263-286.
Shoele, K., and Mittal, R., "Computational study of flow-induced vibration of a reed in a channel and effect on convective heat transfer," Physics of Fluids, vol. 26, No. 12, 2014, p. 127103.
Shoele, K., and Zhu, Q., "Flow-induced vibrations of a deformable ring," Journal of Fluid Mechanics, vol. 650, 2010, pp. 343-362.
Shoele, K., and Zhu, Q., "Fluid-structure interactions of skeleton-reinforced fins: performance analysis of a paired fin in lift-based propulsion," Journal of Experimental Biology, vol. 212, No. 16, 2009, pp. 2679-2690.
Shoele, K., and Zhu, Q., "Leading edge strengthening and the propulsion performance of flexible ray fins," Journal of Fluid Mechanics, vol. 693, 2012, pp. 402-432.
Smith, K. A., Solis, F. J., and Chopp, D., "A projection method for motion of triple junctions by level sets," Interfaces and free boundaries, vol. 4, No. 3, 2002, pp. 263-276.
Son, G., and Dhir, V., "Numerical simulation of film boiling near critical pressures with a level set method," Journal of Heat Transfer, vol. 120, No. 1, 1998, pp. 183-192.
Son, G., Dhir, V., and Ramanujapu, N., "Dynamics and heat transfer associated with a single bubble during nucleate boiling on a horizontal surface," Journal of Heat Transfer, vol. 121, No. 3, 1999, pp. 623-631.
Stephan, P., and Busse, C., "Analysis of the heat transfer coefficient of grooved heat pipe evaporator walls," International Journal of heat and mass transfer, vol. 35, No. 2, 1992, pp. 383-391.
Stephan, P., and Hammer, J., "A new model for nucleate boiling heat transfer" Ein neues Modell für den Wärmeübergang beim Blasensieden, Heat and Mass Transfer, vol. 30, No. 2, 1994, pp. 119-125. English Abstract.
Sussman, M., Almgren, A. S., Bell, J. B., Colella, P., Howell, L. H., and Welcome, M. L., "An adaptive level set approach for incompressible two-phase flows," Journal of Computational Physics, vol. 148, No. 1, 1999, pp. 81-124.
Sussman, M., Smereka, P., and Osher, S., "A level set approach for computing solutions to incompressible two-phase flow," Journal of Computational physics, vol. 114, No. 1, 1994, pp. 146-159.
Tanguy, S., Sagan, M., Lalanne, B., Couderc, F., and Colin, C., "Benchmarks and numerical methods for the simulation of boiling flows," Journal of Computational Physics, vol. 264, 2014, pp. 1-22.

(56) References Cited

OTHER PUBLICATIONS

Tryggvason, G., and Lu, J., "Direct numerical simulations of flows with phase change," Procedia IUTAM, vol. 15, 2015, pp. 2-13.
Tryggvason, G., Bunner, B., Esmaeeli, A., Juric, D., Al-Rawahi, N., Tauber, W., Han, J., Nas, S., and Jan, Y.-J., "A fronttracking method for the computations of multiphase flow," Journal of Computational Physics, vol. 169, No. 2, 2001, pp. 708-759.
Ubbink, O., "Numerical prediction of two fluid systems with sharp interfaces," Ph.D. thesis, University of London PhD Thesis, 1997.
Vahab, M., Miller, G., et al., "A front-tracking shock-capturing method for two gases," Communications in Applied Mathematics and Computational Science, vol. 11, No. 1, 2016, pp. 1-35.
Vahab, M., Pei, C., Hussaini, M. Y., Sussman, M., and Lian, Y., "An adaptive coupled level set and moment-of-fluid method for simulating droplet impact and solidification on solid surfaces with application to aircraft icing," 54th AIAA Aerospace Sciences Meeting, 2016, p. 1340.
Vahab, M., Shoele, K., Hussaini,M. Y., and Sussman, M., "A continuous moment-of-fluid method with reconstructed distance function for simulating multiphase flows," 2018.
Wang, K., Lea, P., and Farhat, C., "A computational framework for the simulation of high-speed multi-material fluid-structure interaction problems with dynamic fracture," International Journal for Numerical Methods in Engineering, vol. 104, No. 7, 2015, pp. 585-623.
Weymouth, G., and Yue, D. K.-P., "Conservative Volume-of-Fluid method for free-surface simulations on Cartesian-grids," Journal of Computational Physics, vol. 229, No. 8, 2010, pp. 2853-2865.
Youngs, D. L., "Time-dependent multi-material flow with large fluid distortion," Numerical methods for fluid dynamics, 1982.

* cited by examiner

ACTIVE VORTEX GENERATOR TO IMPROVE HEAT TRANSFER IN HEAT EXCHANGERS

CROSS-REFERENCE TO RELATED APPLICATIONS

This application claims the benefit of U.S. Provisional Application Ser. No. 62/805,491 filed Feb. 14, 2019, the disclosure of which is expressly incorporated herein by reference.

BACKGROUND

A passive rigid mixer, or static mixer, may be used in a fluid channel of a heat exchanger to increase mixing through the channel and thereby increase the heat transfer rate of the heat exchanger. However, being passive and rigid, such mixers are not adaptive to changing flow rates of the fluid through the channel. Therefore, the mixing provided by a passive rigid mixer is less effective—particularly when the flow is laminar. Two-phase heat exchangers provide large heat transfer rates by inducing a phase change in a liquid to thereby leverage the latent heat of vaporization. However, bubbles formed as part of the boiling process may act as insulators, thereby limiting a maximum heat transfer rate of the heat exchanger without proper bubble management.

SUMMARY

In a first aspect of the disclosure, a heat exchanger with an active vortex generator comprises a cooling fluid channel comprising a heat transfer surface. The cooling fluid channel is adapted to receive a flow of a cooling fluid along a length of the cooling fluid channel. The heat exchanger also comprises an anchor extending across the cooling fluid channel in a direction perpendicular to the length of the cooling fluid channel and parallel to the heat transfer surface. The heat exchanger also comprises an active vortex generator affixed to the anchor and configured to extend in a direction parallel to the heat transfer surface.

In some implementations of the first aspect of the disclosure, the anchor is a rod, bar, tube, or beam.

In some implementations of the first aspect of the disclosure, the active vortex generator comprises a flexible sheet of material selected. A leading edge of the flexible sheet of material is affixed to the anchor as a rotatable joint and a trailing edge of the flexible sheet of material is free to move within the cooling fluid channel.

In some implementations of the first aspect of the disclosure, the sheet of material is selected from a group of flexible materials consisting of a metal plate, a polymeric plate, and a textile sheet.

In some implementations of the first aspect of the disclosure, the active vortex generator comprises a sheet of material with a rigid portion and a flexible portion. A leading edge of the sheet of material comprises the rigid portion and a trailing edge of the sheet of material comprises the flexible portion. The leading edge of the sheet of material is affixed to the anchor as a rigid joint and the trailing edge of the sheet of material is free to move within the cooling fluid channel.

In some implementations of the first aspect of the disclosure, the active vortex generator comprises a rigid sheet of material affixed to the anchor as a rigid joint.

In some implementations of the first aspect of the disclosure, the active vortex generator is configured to extend in a direction counter to the flow of the cooling fluid in the cooling fluid channel.

In some implementations of the first aspect of the disclosure, the active vortex generator comprises a sheet of material with a length between 0.5-2.5 mm.

In some implementations of the first aspect of the disclosure, a width of the sheet of material is substantially the same dimension as the length of the sheet of material.

In some implementations of the first aspect of the disclosure, a width of the cooling fluid channel is 2-3 times the length of the sheet of material.

In some implementations of the first aspect of the disclosure, a thickness of the sheet of material is less than 0.05 times the length of the sheet of material.

In some implementations of the first aspect of the disclosure, the heat exchanger further comprises an actuator coupled to the anchor and configured to move the anchor along an oscillation path within the cooling fluid channel.

In some implementations of the first aspect of the disclosure, the actuator is coupled to a first end of the anchor and the heat exchanger further comprising a second actuator coupled to a second end of the anchor and configured to move the anchor along the oscillation path.

In some implementations of the first aspect of the disclosure, the actuator is configured to move the anchor along the oscillation path at a frequency of 0.05-0.2 seconds.

In a second aspect of the disclosure, an active vortex generator for a heat exchanger comprises an anchor adapted to be coupled across a fluid channel and parallel to a heat transfer surface in the fluid channel. The active vortex generator also comprises an active vortex generator affixed to the anchor and adapted to extend in a direction parallel to the heat transfer surface. The active vortex generator also comprises an actuator coupled to the anchor and adapted to move the anchor along an oscillation path within the cooling fluid channel.

In some implementations of the second aspect of the disclosure, the actuator is coupled to a first end of the anchor and the active vortex generator further comprises a second actuator coupled to a second end of the anchor and configured to move the anchor along the oscillation path.

In some implementations of the second aspect of the disclosure, the actuator is configured to move the anchor along the oscillation path at a frequency of 0.05-0.2 seconds.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents. Use of the phrase "and/or" indicates that any one or any combination of a list of options can be used. For example, "A, B, and/or C" means "A", or "B", or "C", or "A and B", or "A and C", or "B and C", or "A and B and C".

An active vortex generator adapts to a flow rate of fluid through and/or a heat flux applied through a heat exchanger channel to improve the heat transfer rate of the heat exchanger. The term "active" is used herein to denote that the vortex generator has at least one component that moves within the fluid channel of the heat exchanger. In some implementations, the movement of the active vortex generator may be induced by the fluid flow through the heat exchanger channel, such as with an "anchored" active vortex generator. For example, an anchored active vortex generator may be implemented as a normal or inverted flag in the heat exchanged channel.

In some implementations, the movement of the active vortex generator may be induced through an externally applied force on the active vortex generator, or "actuated" active vortex generator. For example, an actuated active vortex generator may be implemented as an oscillating normal flag, a half-flexible oscillating normal flag, or a rigid oscillating plate. An actuated active vortex generator is particularly suited to heat exchangers with high heat flux dissipation requirements. In some implementations, a "high" heat flux is greater than or equal to 1 $kW/cm^2$. For example, on a power laser diode, energy from the power laser diode may be concentrated in a 50×50 micrometer surface. Likewise, on a central processor unit (CPU), the locations of each core of a multi-core processor may present high heat flux dissipation requirements. Locating an actuated active vortex generator proximate to such high heat flux dissipation locations provides for improved heat transfer that can be activated when needed (e.g., upon operation of the power laser diode or a corresponding core of a multi-core processor).

Figure 1:
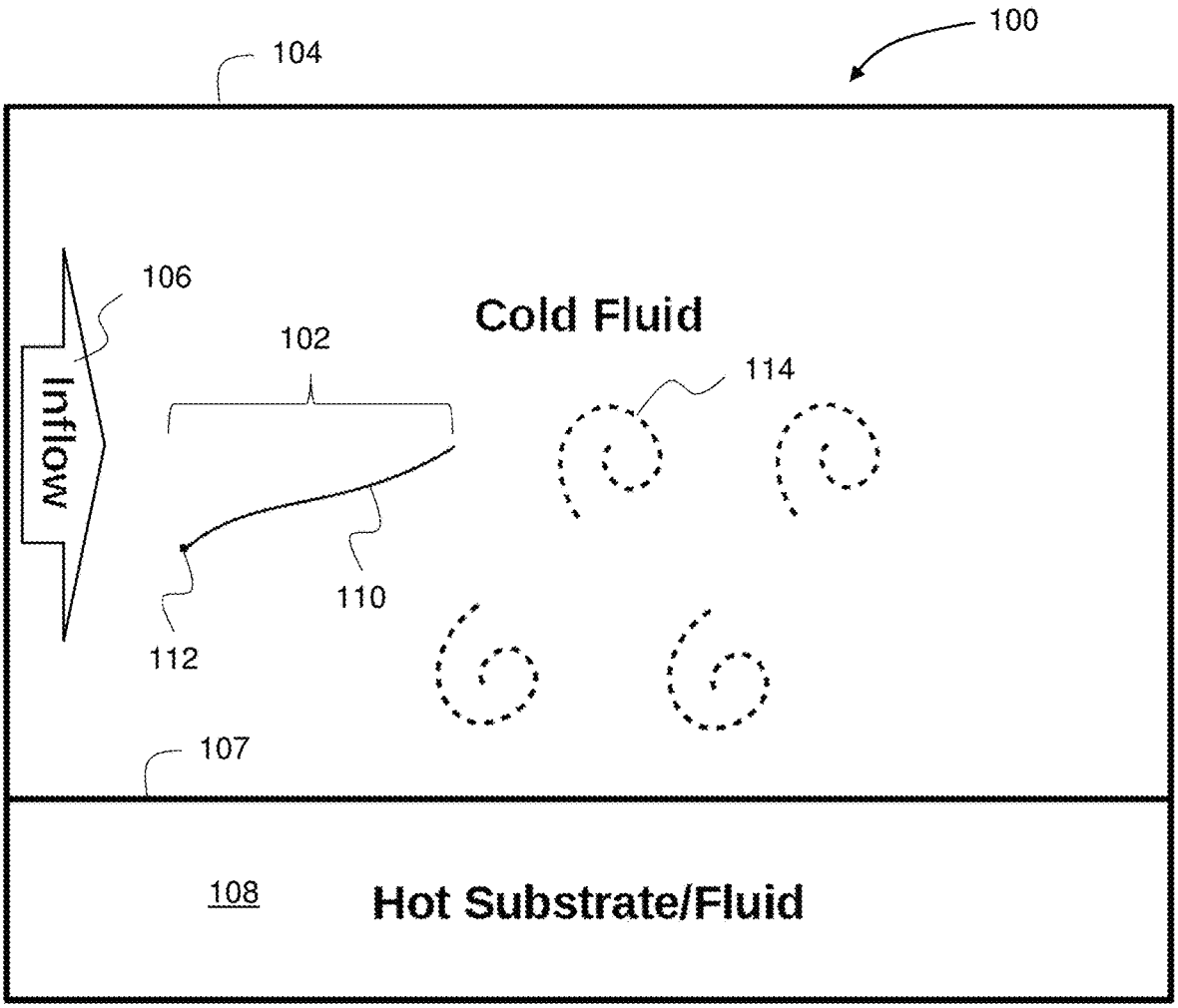
FIG. 1 is a cross-sectional view of a heat exchanger with an active vortex generator comprising an anchored normal flag.
Figure 2:
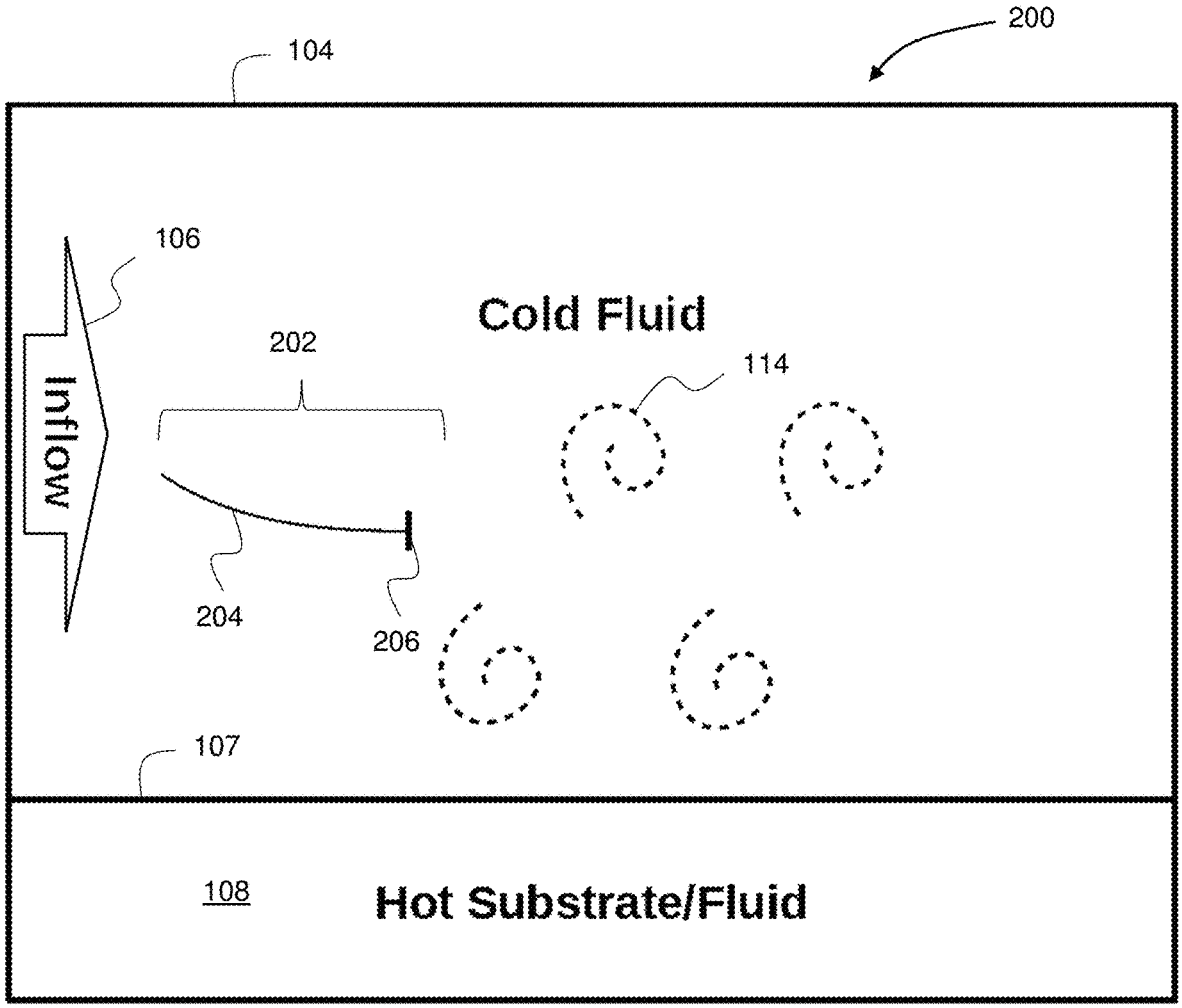
FIG. 2 is a cross-sectional view of a heat exchanger with an active vortex generator comprising an anchored inverted flag.

FIGS. 1 and 2 are cross-sectional views of a heat exchanger with anchored active vortex generators. For an anchored flag (e.g., normal flag or inverted flag), there is a minimum fluid velocity for initiating the generation of a vortex (e.g., causing the flag to "flap"). As understood by those of ordinary skill in the art, the minimum fluid velocity for generating a vortex with an anchored flag is based on one or more of the fluid density, fluid velocity, material properties of the flag (e.g., Young's modulus of the flag, thickness of the flag, and/or density of the flag), and the length of the flag. As the fluid velocity increases above the minimum fluid velocity, the anchored flag will generate vortices at an increasing frequency.

FIG. 1 is a cross-sectional view of a heat exchanger 100 with an active vortex generator comprising an anchored normal flag 102. The heat exchanger 100 comprises a fluid channel 104 through which a cooling fluid 106 flows. In the example shown in FIG. 1, the cooling fluid 106 flows in a direction of the inflow arrow (e.g., from left to right across the page). In various implementations, the cooling fluid 106 is a liquid, such as water or other cooling liquid. A heat transfer surface 107 of the fluid channel 104 is in thermally conductive contact with a substrate 108 to be cooled by the cooling fluid 106. The substrate 108 comprises a heat source, such as one or more electronics components or a flow of hot fluid to be cooled.

The anchored normal flag 102 comprises a flag 110 coupled to an anchor 112. The anchor 112 is affixed across the fluid channel 104 in a direction perpendicular to the flow of the cooling fluid 106 and parallel to the heat transfer surface 107. For example, when the fluid channel 104 has a rectangular cross-sectional shape in a direction perpendicular to the flow of the cooling fluid 106, the anchor 112 may be affixed across lateral surfaces of the fluid channel 104. Other cross-sectional shapes of the fluid channel 104 in a direction perpendicular to the flow of the cooling fluid 106 are contemplated by this disclosure, such as circular, oval, triangular, or any other desired shape.

A leading edge of the flag 110 is affixed to the anchor 112 as a rotatable joint or hinge and the flag 110 extends from the anchor 112 in a direction of the flow of the cooling fluid 106. A trailing edge of the flag 110 is free to move within the cooling fluid 106. The flag 110 is a flexible material selected to wave within the cooling fluid 106 to produce a vortex 114. For example, the flag 110 may be a thin metal plate, polymeric plate, textile sheet, or any other suitably flexible material.

In an example, a length of the flag 110 is between 0.5-2.5 mm. A width of the flag 110 is substantially the same dimension as the length of the flag 110. The width of the fluid channel 104 is 2-3 times the length of the flag 110 (e.g., 1-7.5 mm). A thickness of the flag 110 is less than 0.05 times the length of the flag 110.

As show, the flag 110 produces a vortex 114 upon a change in a direction of the wave of the flag 110. As such, a series of vortices 114 are produced at a top most (e.g., direction furthest from the heat transfer surface 107) motion of the flag 110 as well as at a bottom most (e.g., direction closest to the heat transfer surface 107) motion of the flag 110.

The anchor 112 is affixed across the fluid channel 104 at a location closer to the heat transfer surface 107 than a surface of the fluid channel 104 opposite to the heat transfer surface 107. Accordingly, the vortices 114 generated by the flag 110 are produced in a viscous/thermal boundary layer along the heat transfer surface 107 to thereby increase the heat transfer rate of the heat exchanger 100.

The vortices 114 generated by the flag 110 promote mixing of the cooling fluid 106 to prevent temperature stratification about the heat transfer surface and increase the heat transfer rate from the substrate 108 into the cooling fluid 106. As understood by those of ordinary skill in the art, the motion of the flag 110 is induced by the fluid flow of the cooling fluid 106. As the velocity of the cooling fluid 106 is increased, the frequency at which the vortices 114 are generated likewise increases. Accordingly, in some implementations, the heat transfer rate of the heat exchanger 104 may be modulated based on controlling the flow rate of the cooling fluid 106.

FIG. 2 is a cross-sectional view of a heat exchanger 200 with an active vortex generator comprising a anchored inverted flag 202. The heat exchanger 200 is substantially the same as the heat exchanger 100 with the anchored normal flag 102 substituted for the anchored inverted flag 202. A description of the common components between the heat exchanger 100 and the heat exchanger 200 is omitted and reference is made to the description of these components above.

The anchored inverted flag 202 comprises a flag 204 coupled to an anchor 206. The anchor 206 is affixed across the fluid channel 104 in a direction perpendicular to the flow of the cooling fluid 106 and parallel to the heat transfer surface 107. For example, when the fluid channel 104 has a rectangular cross-sectional shape in a direction perpendicular to the flow of the cooling fluid 106, the anchor 112 may be affixed across lateral surfaces of the fluid channel 104. Other cross-sectional shapes of the fluid channel 104 in a direction perpendicular to the flow of the cooling fluid 106 are contemplated by this disclosure, such as circular, oval, triangular, or any other desired shape.

A trailing edge of the flag 204 is affixed to the anchor 206 as a rigid joint and the flag 204 extends from the anchor 206 in a direction opposite the flow of the cooling fluid 106. A leading edge of the flag 204 is free to move within the cooling fluid 106. The flag 204 is a flexible material selected to wave within the cooling fluid 106 to produce a vortex 114. For example, the flag 204 may be a thin metal plate, polymeric plate, textile material, or any other suitably flexible material. In various implementations, the flag 204 is more rigid than the flag 110.

In an example, a length of the flag 204 is between 0.5-2.5 mm. A width of the flag 204 is substantially the same dimension as the length of the flag 204. The width of the fluid channel 104 is 2-3 times the length of the flag 204 (e.g., 1-7.5 mm). A thickness of the flag 204 is less than 0.05 times the length of the flag 204.

As show, the flag 204 produces a vortex 114 upon a change in a direction of the wave of the flag 204. As such, a series of vortices 114 are produced at a top most (e.g., direction furthest from the heat transfer surface 107) motion of the flag 204 as well as at a bottom most (e.g., direction closest to the heat transfer surface 107) motion of the flag 204.

The anchor 206 is affixed across the fluid channel 104 at a location closer to the heat transfer surface 107 than a surface of the fluid channel 104 opposite to the heat transfer surface 107. Accordingly, the vortices 114 generated by the flag 204 are produced in a viscous/thermal boundary layer along the heat transfer surface 107 to thereby increase the heat transfer rate of the heat exchanger 200.

Figure 3:
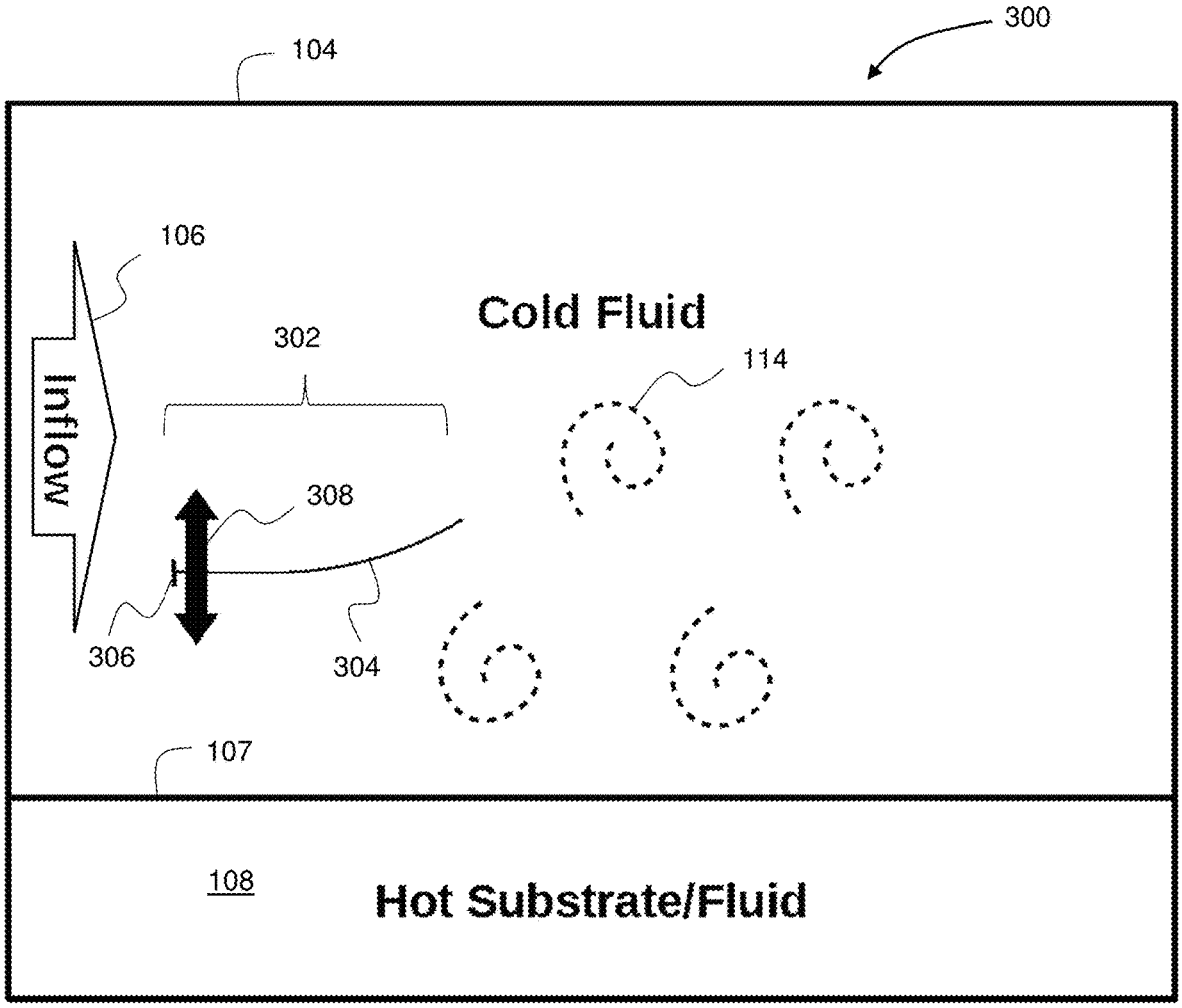
FIG. 3 is a cross-sectional view of a heat exchanger with an active vortex generator comprising an oscillating normal flag.

FIG. 3 is a cross-sectional view of a heat exchanger 300 with an active vortex generator comprising an oscillating normal flag 302. The heat exchanger 300 is substantially the same as the heat exchanger 100 with the anchored normal flag 102 substituted for the oscillating normal flag 302. A description of the common components between the heat exchanger 100 and the heat exchanger 300 is omitted and reference is made to the description of these components above.

The oscillating normal flag 302 comprises a flag 304 coupled to an anchor 306. The anchor 306 is positioned across the fluid channel 104 in a direction perpendicular to the flow of the cooling fluid 106 and parallel to the heat transfer surface 107. One or more actuators (not shown) are coupled to the anchor 306 and configured to move the anchor 306 in a direction shown by an arrow 308, which is perpendicular to the heat transfer surface 107 while still maintaining the orientation of the anchor 306 parallel to the heat transfer surface 107. The actuator(s) are configured to move the anchor 306 along an oscillation path between a top most position (e.g., a position in the oscillation path furthest from the heat transfer surface 107) and a bottom most position (e.g., a position in the oscillation path closest to the heat transfer surface 107).

A leading edge of the flag 304 is affixed to the anchor 306 as a rigid joint and the flag 304 extends from the anchor 306 in a direction of the flow of the cooling fluid 106. A trailing edge of the flag 304 is free to move within the cooling fluid 106. The flag 304 is a flexible material selected to wave within the cooling fluid 106 to produce a vortex 114. For example, the flag 304 may be a thin metal plate, polymeric plate, textile material, or any other suitably flexible material.

In an example, a length of the flag 304 is between 0.5-2.5 mm. A width of the flag 304 is substantially the same dimension as the length of the flag 304. The width of the fluid channel 104 is 2-3 times the length of the flag 304 (e.g., 1-7.5 mm). A thickness of the flag 304 is less than 0.05 times the length of the flag 304. An amplitude of the oscillation of the anchor 306 along the oscillation path is 0.5-1 times the length of the flag 304. The actuator(s) are configured to oscillate the anchor 306 along the oscillation path at a frequency of 0.05-0.2 seconds.

As show, the flag 304 produces a vortex 114 upon a change in a direction of the wave of the flag 304. As such, a series of vortices 114 are produced at a top most (e.g., direction furthest from the heat transfer surface 107) motion of the flag 304 as well as at a bottom most (e.g., direction closest to the heat transfer surface 107) motion of the flag 304.

The oscillation path of the anchor 306 is along a surface of the fluid channel 104 at a location closer to the heat transfer surface 107 than a surface of the fluid channel 104 opposite to the heat transfer surface 107. Accordingly, the vortices 114 generated by the flag 304 are produced in a viscous/thermal boundary layer along the heat transfer surface 107 to thereby increase the heat transfer rate of the heat exchanger 300.

In some implementations, the flag 304 may be sufficiently rigid to resist induced generation of the vortices 114 due to the flow of the cooling fluid 106, but sufficiently flexible that motion of the anchor 306 caused by the actuator(s) causes the flag 304 to flex and produce a vortex 114. Accordingly, the generation of the vortices 114 is controlled by activation of the actuator(s). The actuator(s) may manipulate a frequency at which the anchor 306 travels along the oscillation path to produce more or fewer vortices 114, as desired.

Figure 4:
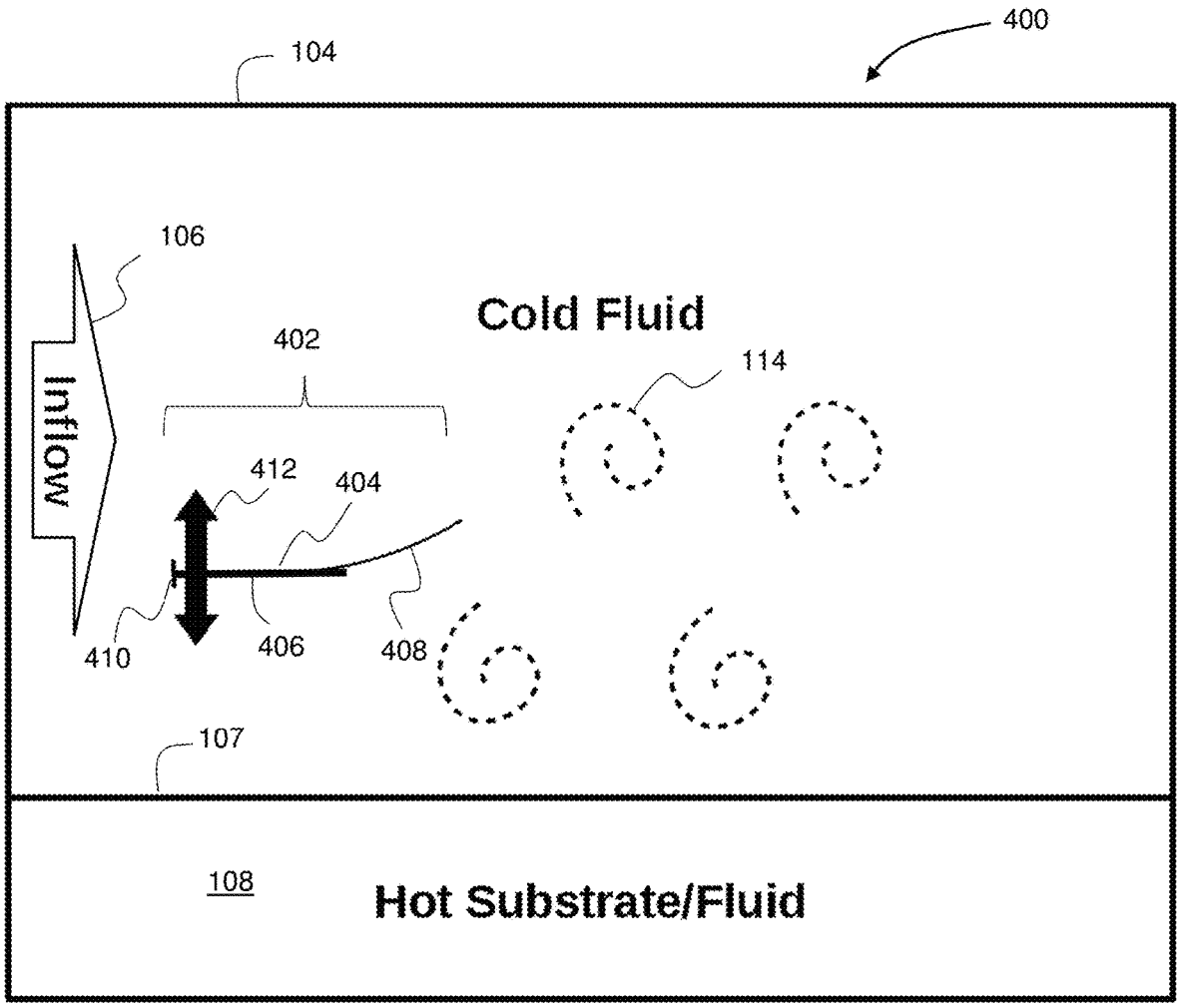
FIG. 4 is a cross-sectional view of a heat exchanger with an active vortex generator comprising a half-flexible oscillating normal flag.

FIG. 4 is a cross-sectional view of a heat exchanger 400 with an active vortex generator comprising a half-flexible oscillating normal flag 402. The heat exchanger 400 is substantially the same as the heat exchanger 100 with the anchored normal flag 102 substituted for the half-flexible oscillating normal flag 402. A description of the common components between the heat exchanger 100 and the heat exchanger 400 is omitted and reference is made to the description of these components above.

The half-flexible oscillating normal flag 402 comprises a flag 404 coupled to an anchor 410. The flag 404 comprises a rigid portion 406 and a flexible portion 408. The anchor 410 is positioned across the fluid channel 104 in a direction perpendicular to the flow of the cooling fluid 106 and parallel to the heat transfer surface 107. One or more actuators (not shown) are coupled to the anchor 410 and configured to move the anchor 410 in a direction shown by an arrow 412, which is perpendicular to the heat transfer surface 107 while still maintaining the orientation of the anchor 410 parallel to the heat transfer surface 107. The actuator(s) are configured to move the anchor 410 along an oscillation path between a top most position (e.g., a position in the oscillation path furthest from the heat transfer surface 107) and a bottom most position (e.g., a position in the oscillation path closest to the heat transfer surface 107).

A leading edge of the flag 404 is affixed to the anchor 410 as a rigid joint and the flag 404 extends from the anchor 410 in a direction of the flow of the cooling fluid 106. The flexible portion 408 of the flag 404 is coupled to the rigid portion 406 as a rigid joint. A trailing edge of the flag 404 is free to move within the cooling fluid 106. The flexible portion 408 of the flag 404 is a flexible material selected to wave within the cooling fluid 106 to produce a vortex 114. For example, the flexible portion 408 of the flag 404 may be a thin metal plate, polymeric plate, textile material, or any other suitably flexible material. The rigid portion 406 of the flag 404 is selected to be sufficiently rigid to resist flexing as the anchor 410 is moved within the cooling fluid 106. For example, the rigid portion 406 of the flag 404 may be a thicker metal plate, polymeric plate, or other sufficiently rigid plate than the flexible portion 408 of the flag 404.

In an example, a length of the flag 404 is between 0.5-2.5 mm. A width of the flag 404 is substantially the same dimension as the length of the flag 404. The rigid portion 406 of the flag 404 is half the length of the flag 404. The width of the fluid channel 104 is 2-3 times the length of the flag 404 (e.g., 1-7.5 mm). A thickness of the flag 404 is less than 0.05 times the length of the flag 404. An amplitude of the oscillation of the anchor 410 along the oscillation path is 0.5-1 times the length of the flag 404. The actuator(s) are configured to oscillate the anchor 410 along the oscillation path at a frequency of 0.05-0.2 seconds.

As show, the flag 404 produces a vortex 114 upon a change in a direction of the wave of the flag 404. As such, a series of vortices 114 are produced at a top most (e.g., direction furthest from the heat transfer surface 107) motion of the flag 304 as well as at a bottom most (e.g., direction closest to the heat transfer surface 107) motion of the flag 404.

The oscillation path of the anchor 410 is along a surface of the fluid channel 104 at a location closer to the heat transfer surface 107 than a surface of the fluid channel 104 opposite to the heat transfer surface 107. Accordingly, the vortices 114 generated by the flag 404 are produced in a viscous/thermal boundary layer along the heat transfer surface 107 to thereby increase the heat transfer rate of the heat exchanger 400.

In some implementations, the flexible portion 408 of the flag 404 may be sufficiently rigid to resist induced generation of the vortices 114 due to the flow of the cooling fluid 106, but sufficiently flexible that motion of the anchor 410 caused by the actuator(s) causes the flag 404 to flex and produce a vortex 114. The rigid portion 406 of the flag 404 is sufficiently rigid to resist flexing even during motion of the anchor 410 caused by the actuator(s). Accordingly, the generation of the vortices 114 is controlled by activation of the actuator(s). The actuator(s) may manipulate a frequency at which the anchor 410 travels along the oscillation path to produce more or fewer vortices 114, as desired.

Figure 5:
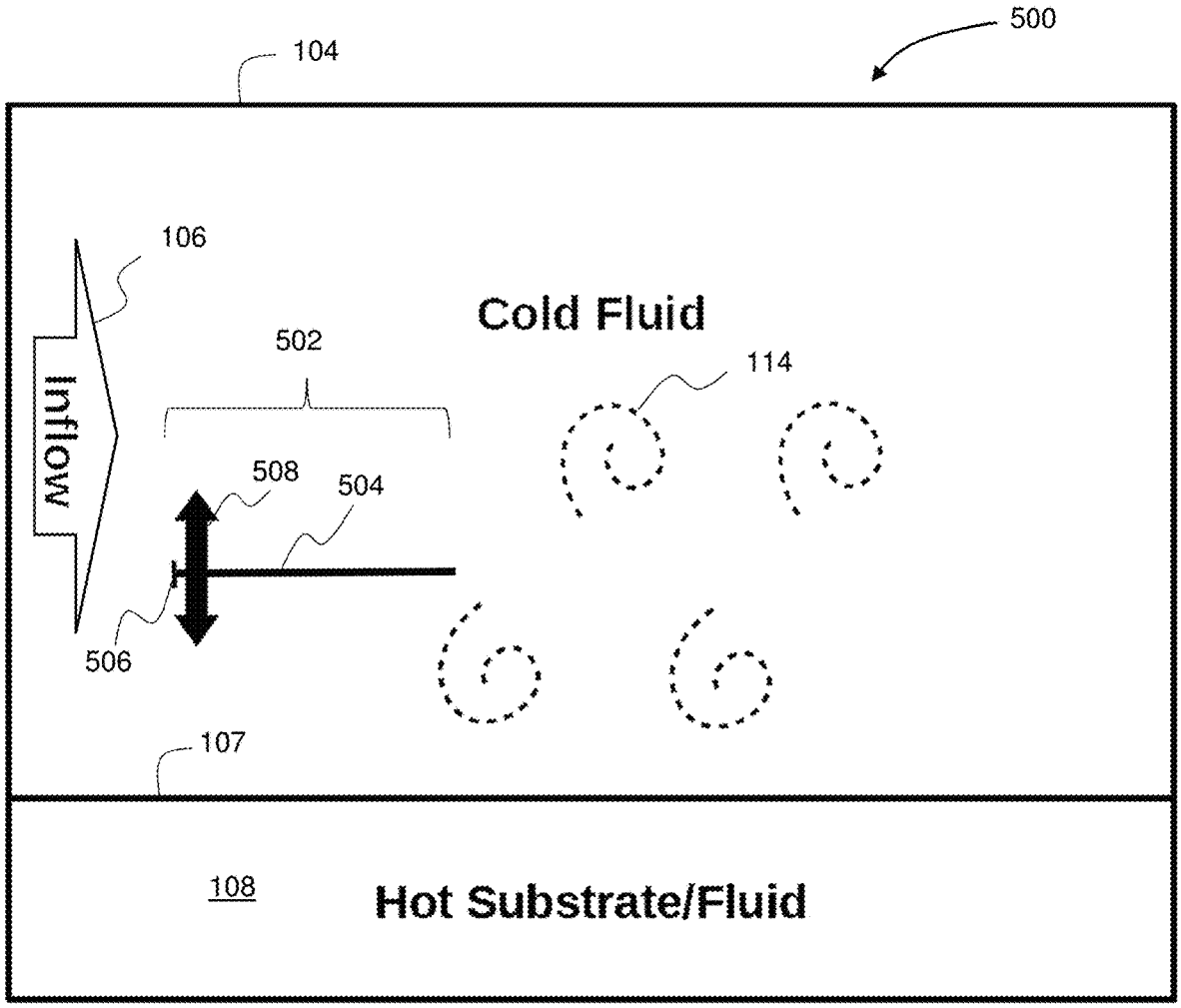
FIG. 5 is a cross-sectional view of a heat exchanger with an active vortex generator comprising a rigid oscillating plate.

FIG. 5 is a cross-sectional view of a heat exchanger 500 with an active vortex generator comprising a rigid oscillating plate 502. The heat exchanger 500 is substantially the same as the heat exchanger 100 with the anchored normal flag 102 substituted for the rigid oscillating plate 502. A description of the common components between the heat exchanger 100 and the heat exchanger 500 is omitted and reference is made to the description of these components above.

The rigid oscillating plate 502 comprises a rigid plate 504 coupled to an anchor 506. The anchor 506 is positioned across the fluid channel 104 in a direction perpendicular to the flow of the cooling fluid 106 and parallel to the heat transfer surface 107. One or more actuators (not shown) are coupled to the anchor 506 and configured to move the anchor 506 in a direction shown by an arrow 508, which is perpendicular to the heat transfer surface 107, while still maintaining the orientation of the anchor 506 parallel to the heat transfer surface 107. The actuator(s) are configured to move the anchor 506 along an oscillation path between a top most position (e.g., a position in the oscillation path furthest from the heat transfer surface 107) and a bottom most position (e.g., a position in the oscillation path closest to the heat transfer surface 107).

A leading edge of the rigid plate 504 is affixed to the anchor 306 as a rigid joint and the rigid plate 504 extends from the anchor 506 in a direction of the flow of the cooling fluid 106. The rigid plate 504 is positioned parallel to the heat transfer surface 107. A trailing edge of the rigid plate 504 is maintained parallel to the leading edge of the rigid plate 504 within the cooling fluid 106. The rigid plate 504 is a sufficiently rigid material selected to resist motion within the cooling fluid 106. For example, the rigid plate 504 may be a metal, ceramic, or polymeric plate, or any other suitably rigid material.

In an example, a length of the rigid plate 504 is between 0.5-2.5 mm. A width of the rigid plate 504 is substantially the same dimension as the length of the rigid plate 504. The width of the fluid channel 104 is 2-3 times the length of the rigid plate 504 (e.g., 1-7.5 mm). A thickness of the rigid plate 504 is less than 0.05 times the length of the rigid plate 504. An amplitude of the oscillation of the anchor 506 along the oscillation path is 0.5-1 times the length of the rigid plate 504. The actuator(s) are configured to oscillate the anchor 506 along the oscillation path at a frequency of 0.05-0.2 seconds.

As show, the rigid plate 504 produces a vortex 114 upon a change in a direction of the rigid plate 504 as caused by the oscillation of the anchor 506 by the actuator(s). As such, a series of vortices 114 are produced at a top most (e.g., direction furthest from the heat transfer surface 107) motion of the rigid plate 504 as well as at a bottom most (e.g., direction closest to the heat transfer surface 107) motion of the rigid plate 504.

The oscillation path of the anchor 506 is along a surface of the fluid channel 104 at a location closer to the heat transfer surface 107 than a surface of the fluid channel 104 opposite to the heat transfer surface 107. Accordingly, the vortices 114 generated by the rigid plate 504 are produced in a viscous/thermal boundary layer along the heat transfer surface 107 to thereby increase the heat transfer rate of the heat exchanger 500.

Because the rigid plate 504 is sufficiently rigid to resist induced generation of the vortices 114 due to the flow of the cooling fluid 106, the generation of the vortices 114 is controlled by activation of the actuator(s). The actuator(s) may manipulate a frequency at which the anchor 506 travels along the oscillation path to produce more or fewer vortices 114, as desired.

Figure 6:
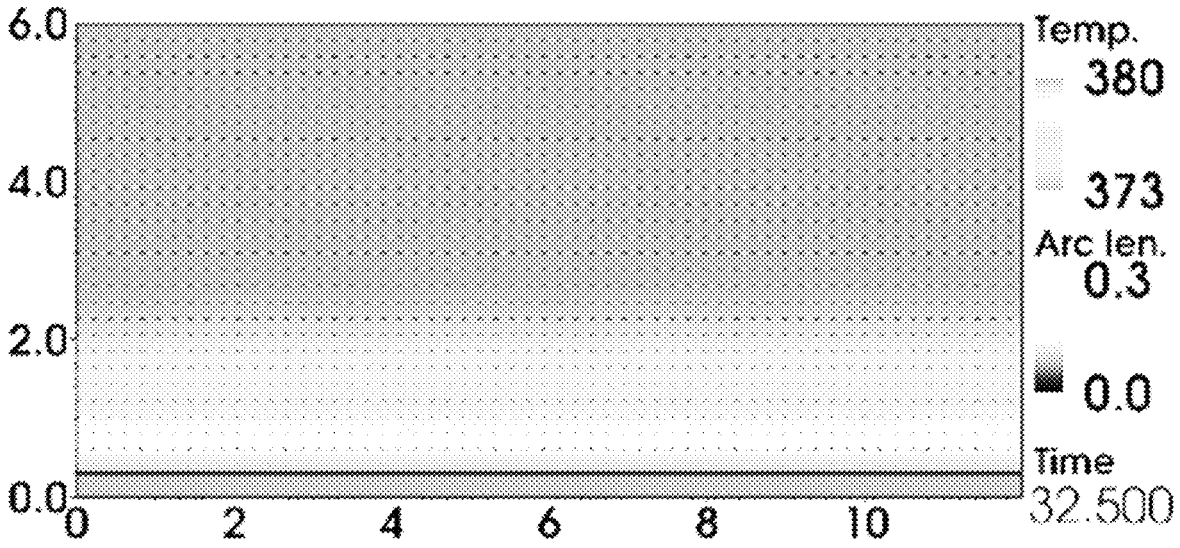
FIG. 6 is a cross-sectional simulation of heat transfer and fluid dynamics across a heat exchanger without a vortex generator.
Figure 7:
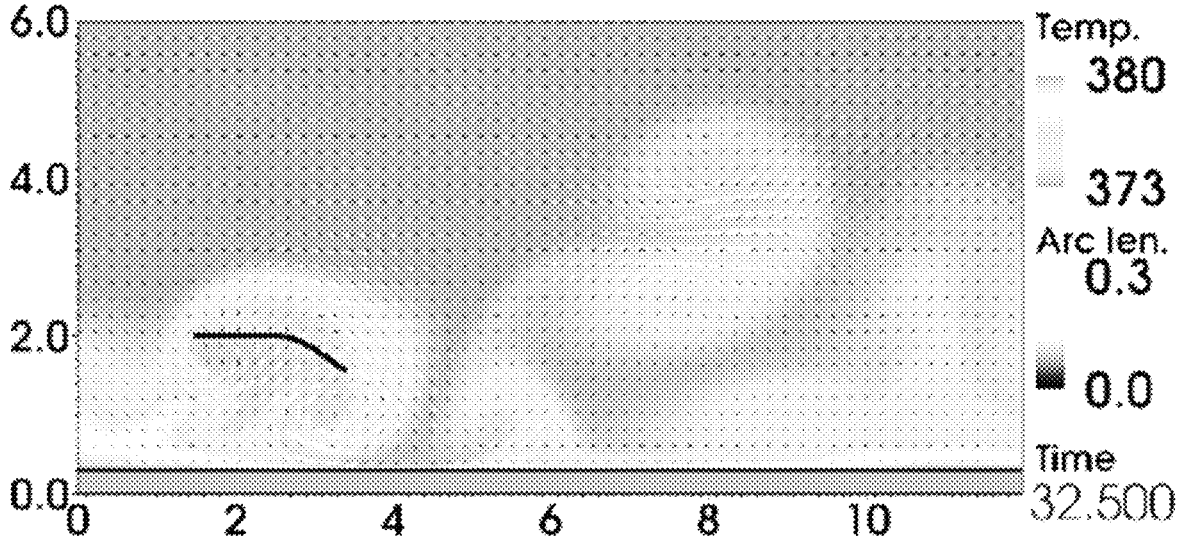
FIG. 7 is a cross-sectional simulation of heat transfer and fluid dynamics across a heat exchanger with an active vortex generator comprising a half-flexible oscillating normal flag.
Figure 8:
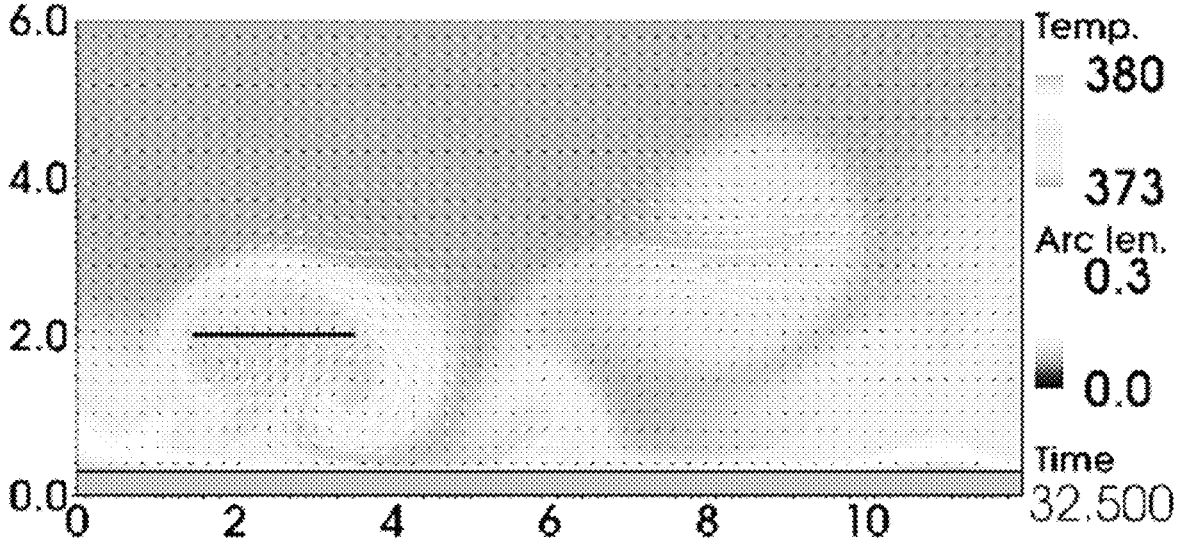
FIG. 8 is a cross-sectional simulation of heat transfer and fluid dynamics across a heat exchanger with an active vortex generator comprising a rigid oscillating plate.
Figure 9:
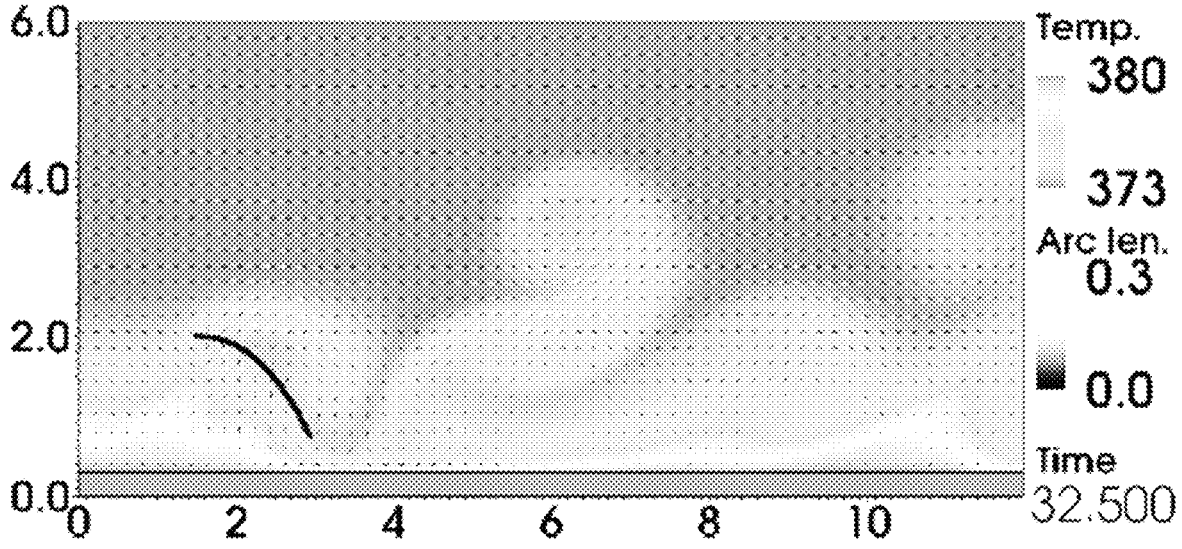
FIG. 9 is a cross-sectional simulation of heat transfer and fluid dynamics across a heat exchanger with an active vortex generator comprising an oscillating normal flag.

FIG. 6 is a cross-sectional simulation of heat transfer and fluid dynamics across a heat exchanger without a vortex generator. FIG. 7 is a cross-sectional simulation of heat transfer and fluid dynamics across the heat exchanger 400 with an active vortex generator comprising the half-flexible oscillating normal flag 402. FIG. 8 is a cross-sectional simulation of heat transfer and fluid dynamics across the heat exchanger 500 with an active vortex generator comprising the rigid oscillating plate 502. FIG. 9 is a cross-sectional simulation of heat transfer and fluid dynamics across the heat exchanger 300 with an active vortex generator comprising the oscillating normal flag 302. FIGS. 6-9 show the active vortex generators at a top most position along the oscillation path.

Figure 10:
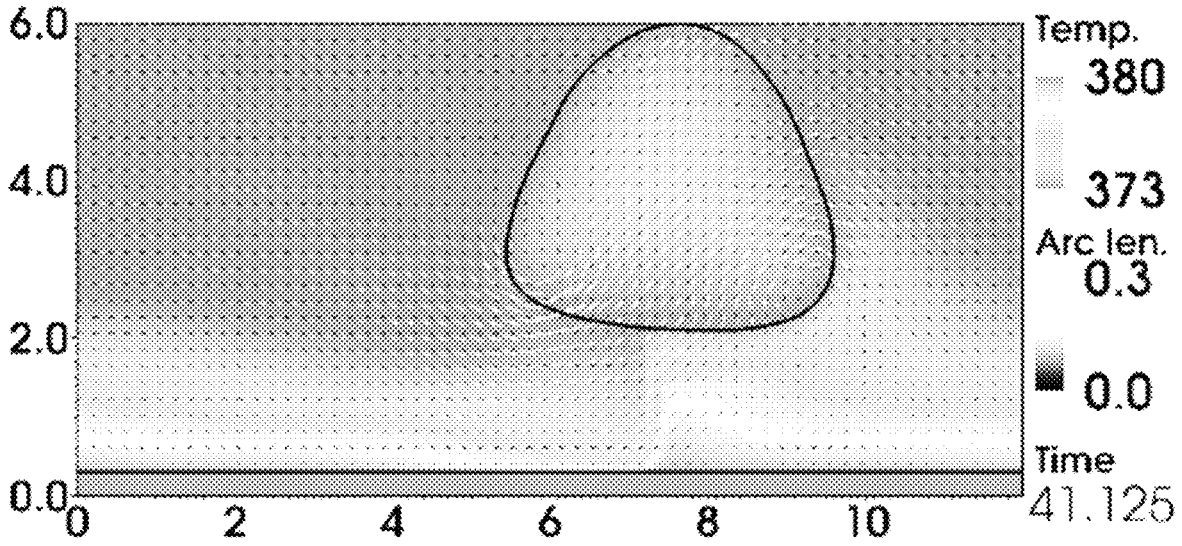
FIG. 10 is a cross-sectional simulation of two-phase heat transfer and fluid dynamics across a heat exchanger without a vortex generator.
Figure 11:
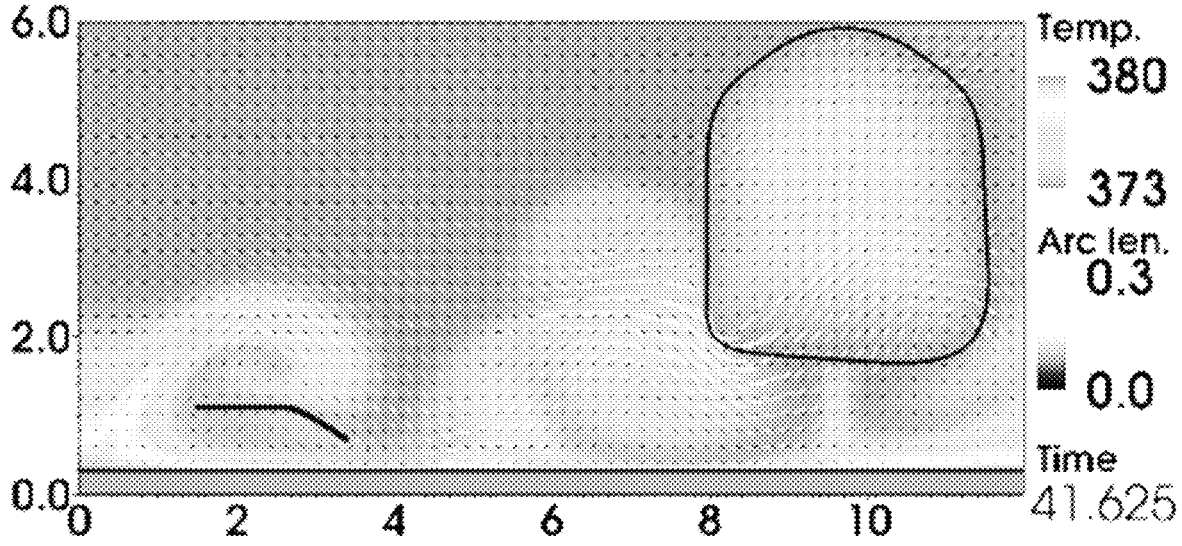
FIG. 11 is a cross-sectional simulation of two-phase heat transfer and fluid dynamics across a heat exchanger with an active vortex generator comprising a half-flexible oscillating normal flag.
Figure 12:
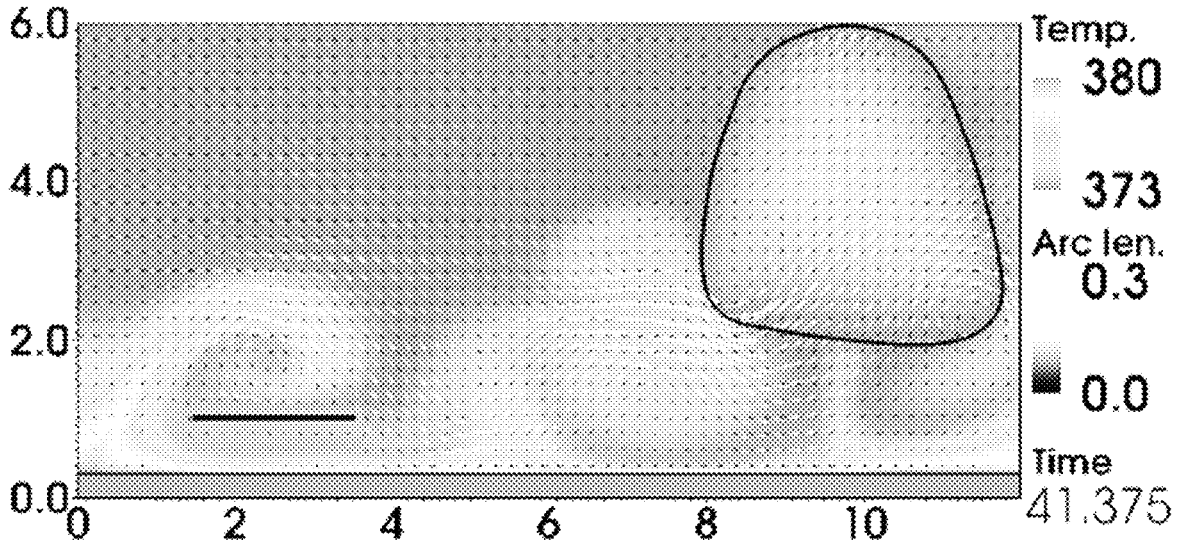
FIG. 12 is a cross-sectional simulation of two-phase heat transfer and fluid dynamics across a heat exchanger with an active vortex generator comprising a rigid oscillating plate.
Figure 13:
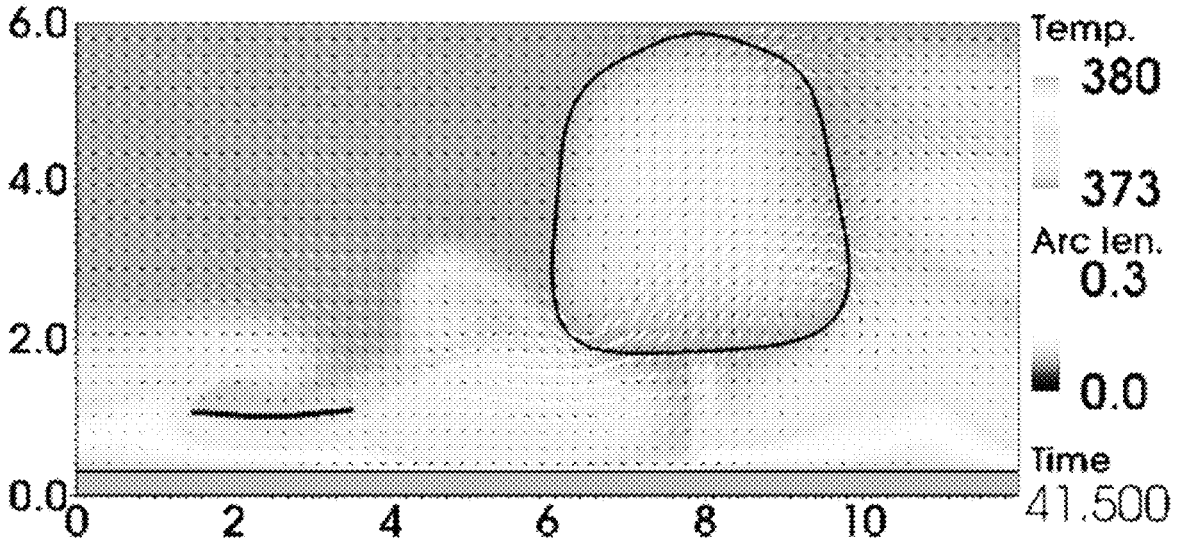
FIG. 13 is a cross-sectional simulation of two-phase heat transfer and fluid dynamics across a heat exchanger with an active vortex generator comprising an oscillating normal flag.

FIG. 10 is a cross-sectional simulation of two-phase heat transfer and fluid dynamics across a heat exchanger without a vortex generator. FIG. 11 is a cross-sectional simulation of two-phase heat transfer and fluid dynamics across the heat exchanger 400 with an active vortex generator comprising the half-flexible oscillating normal flag 402. FIG. 12 is a cross-sectional simulation of two-phase heat transfer and fluid dynamics across the heat exchanger 500 with an active vortex generator comprising the rigid oscillating plate 502. FIG. 13 is a cross-sectional simulation of two-phase heat transfer and fluid dynamics across the heat exchanger 300 with an active vortex generator comprising the oscillating normal flag 302. In each of FIGS. 10-13, the enclosed shape represents a bubble, such as a bubble of steam caused by the boiling of water. FIGS. 10-13 show the active vortex generators at a bottom most position along the oscillation path.

Figure 14:
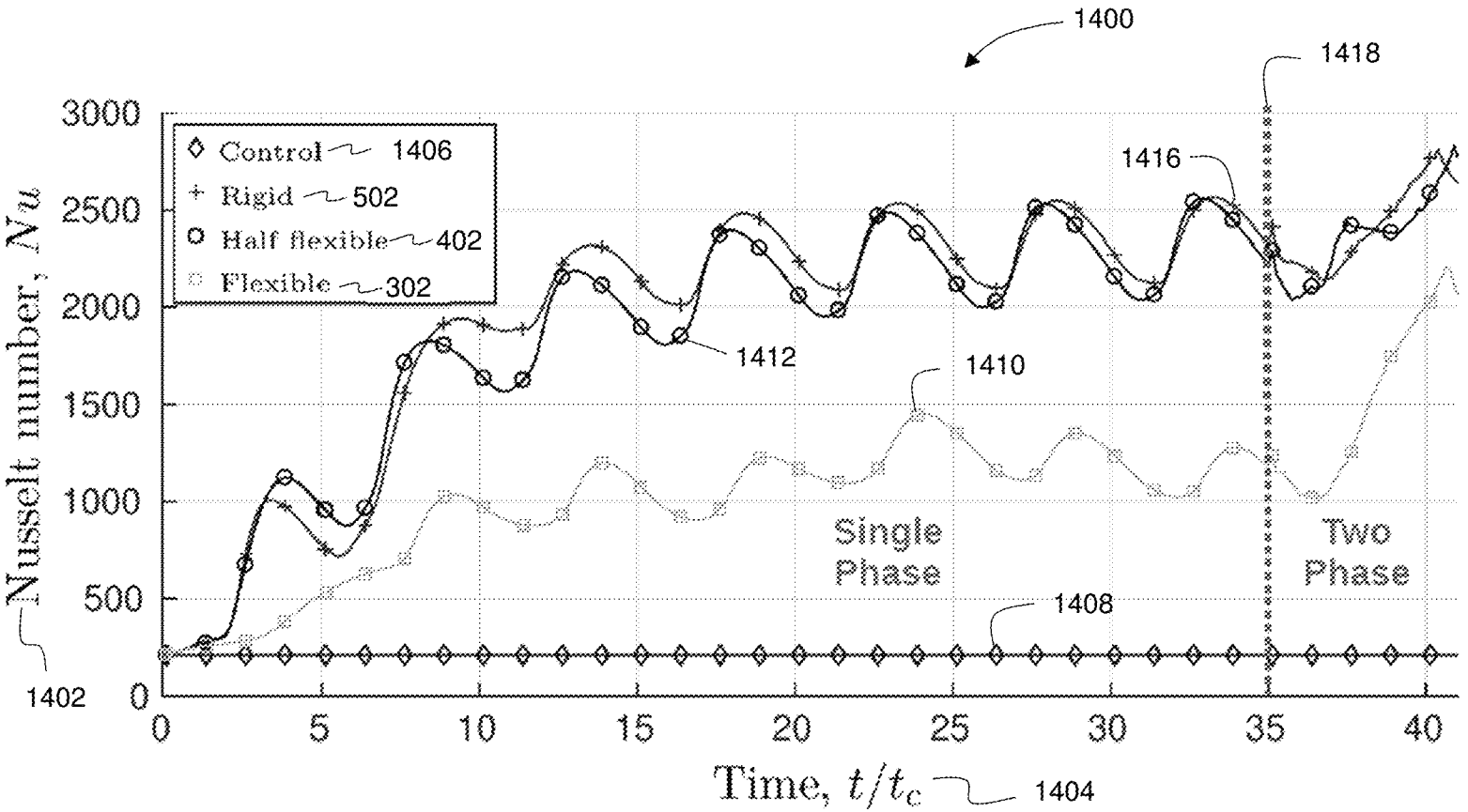
FIG. 14 is a graph of the Nusselt number over time for heat exchangers without a vortex generator and with a vortex generator comprising a half-flexible oscillating normal flag, a rigid oscillating plate, or an oscillating normal flag.
Figure 15:
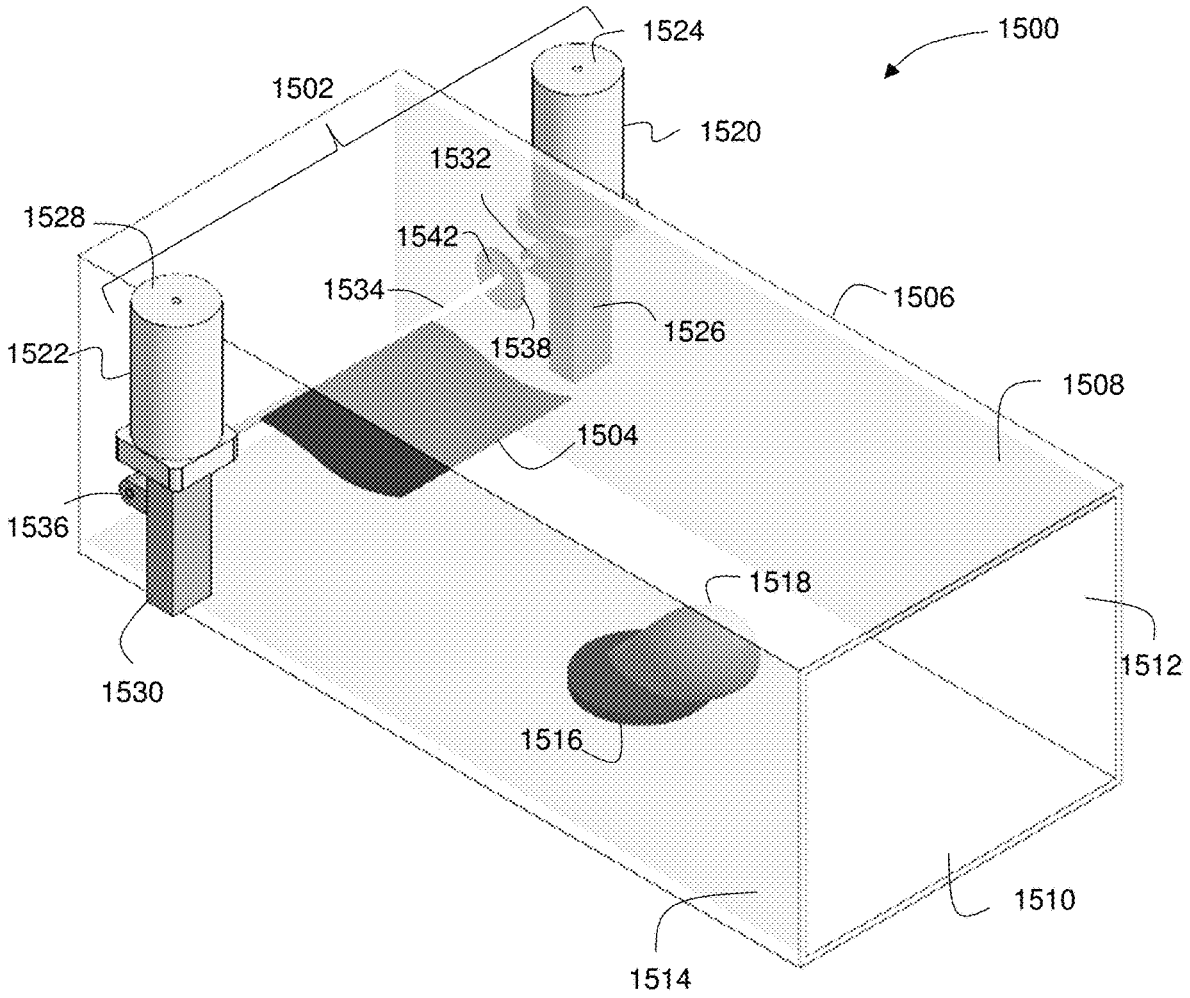
FIG. 15 is a perspective view of an implementation of a heat exchanger with an active vortex generator comprising an oscillating normal flag.
Figure 16:
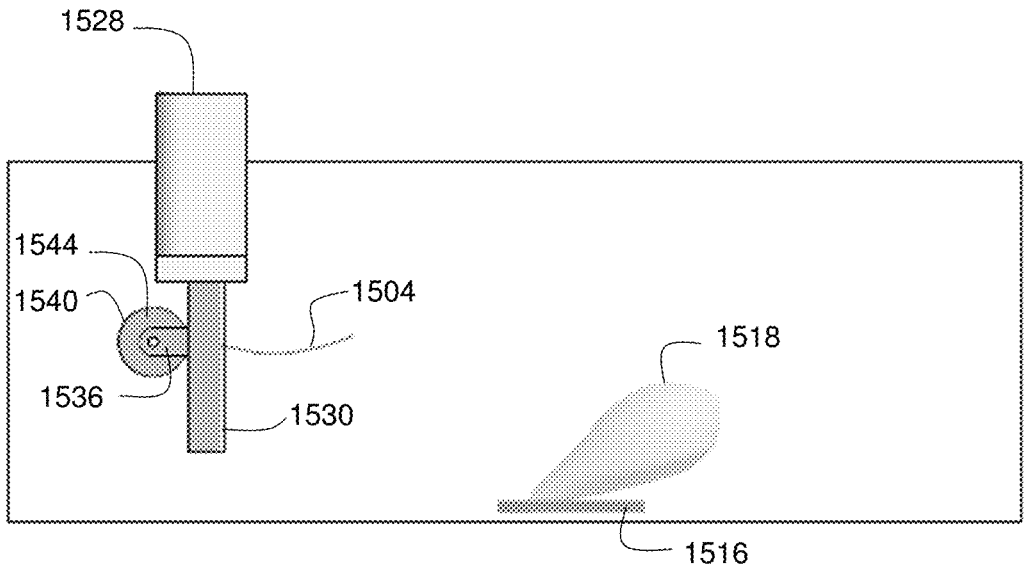
FIG. 16 is a side view of the heat exchanger of FIG. 15.
Figure 17:
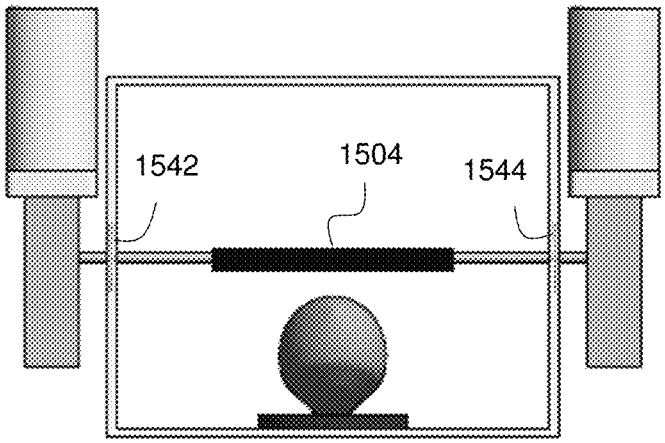
FIG. 17 is a front view of the heat exchanger of FIG. 15.
Figure 18:
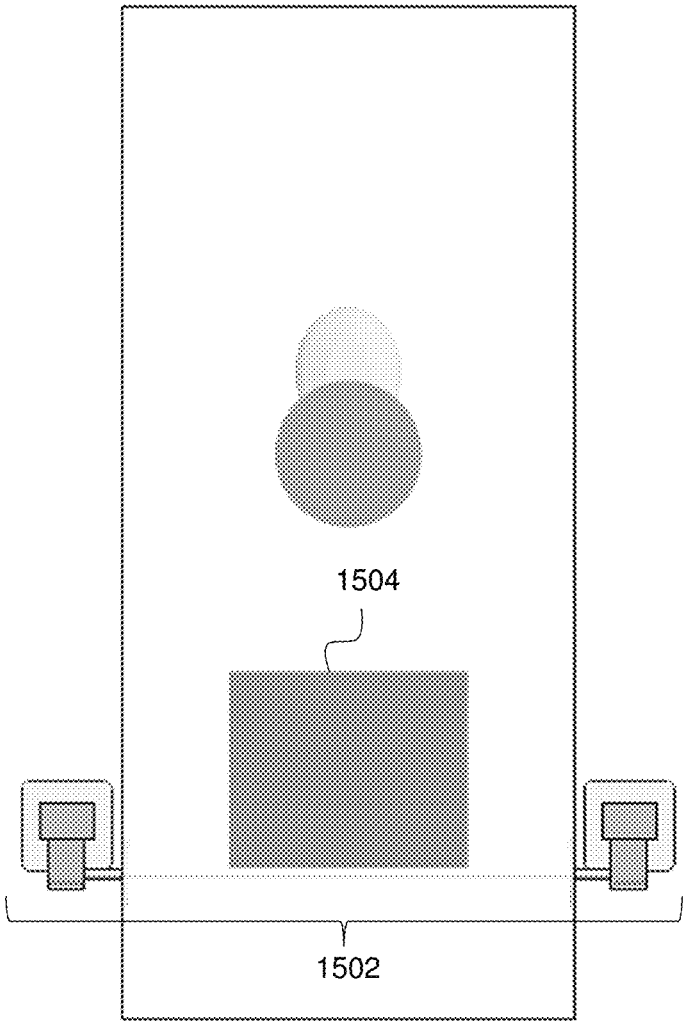
FIG. 18 is a bottom view of the heat exchanger of FIG. 15.

FIG. 14 is a graph 1400 of the Nusselt number 1402 over time 1404 for heat exchangers without an active vortex generator (control) 1406 and with a vortex generator comprising the half-flexible oscillating normal flag 402, the rigid oscillating plate 502, or the oscillating normal flag 302. As shown, a first plot 1408 shows a baseline level of heat transfer provided by a heat exchanger without an active vortex generator. A second plot 1410 shows the heat transfer provided by the heat exchanger 300, described above. A third plot 1412 shows the heat transfer provided by the heat exchanger 400, described above. A fourth plot 1414 shows the heat transfer provided by the heat exchanger 500, described above. As shown in each of the second, third, and fourth plots 1414, there is a periodicity to the heat transfer induced by the oscillation of the respective anchors 306, 410, 506 along the oscillation path by the actuator(s). At a transition time 1418, the heat transfer transitions from a single phase heat transfer to a two-phase heat transfer (e.g., boiling).

As shown, the rigid oscillating plate 502 provides the greatest amount of heat transfer with the half-flexible oscillating normal flag 402 closely tracking to within about 90-96% of the level of heat transfer provided by the rigid oscillating plate 502. However, the amount of work required to oscillate the half-flexible oscillating normal flag 402 is 70% of the amount of work required to oscillate the rigid oscillating plate 502. Likewise, the amount of pressure drop caused by the half-flexible oscillating normal flag 402 is 75% of the amount of pressure drop caused by the rigid oscillating plate 502. After the transition time 1418, the heat transfer provided by the rigid oscillating plate 502 and the half-flexible oscillating normal flag 402 are substantially the same.

The oscillating normal flag 302 provides about 50-60% less heat transfer than the rigid oscillating plate 502 and the half-flexible oscillating normal flag 402 during single phase heat transfer, but still provides five times or more the amount of heat transfer in the single phase heat transfer than in a heat exchanger without a vortex generator. At the same time, the amount of work required to oscillate the oscillating normal flag 302 is 20% of the amount of work required to oscillate the rigid oscillating plate 502. Likewise, the amount of pressure drop caused by the oscillating normal flag 302 is 50% of the amount of pressure drop caused by the rigid oscillating plate 502.

After the transition time 1418, the heat transfer provided by the oscillating normal flag 302 jumps to as much as ten times or more than the heat transfer provided by a heat exchanger without a vortex generator. At the same time, the heat transfer provided by the oscillating normal flag 302 closes to within about 70-75% of the heat transfer as that provided by the rigid oscillating plate 502 and the half-flexible oscillating normal flag 402 during two-phase heat transfer.

Looking back to FIGS. 7, 8, 11, and 12, oscillating the flag 404 with the rigid portion 406 or oscillating the rigid plate 504 produces vortices 114 closer to the heat transfer surface 107 than with the flexible flag 304. Accordingly, for the rigid plate 504 and semi-rigid flag 404, the flow velocity of the cooling fluid 106 is increased near the heat transfer surface 107. As such, in the two-phase heat transfer shown in FIGS. 11 and 12, the bubbles are smaller and pushed away from the heat transfer surface 107 faster than the bubbles shown in FIGS. 10 and 13. The increase flow velocity and closer placement of the vortices 114 to the heat transfer surface 107 allows for continued boiling before reaching a critical heat flux. Specifically, the increase flow velocity and closer placement of the vortices 114 to the heat transfer surface 107 operate to prevent the transition to film boiling.

In operation, oscillating the flag 404 with the rigid portion 406 or oscillating the rigid plate 504 result in a higher heat transfer, but requires more work by the actuator(s), and result in a greater pressure drop across the heat exchangers as compared to the flexible flag 304. Accordingly, the flag 404 with the rigid portion 406 or oscillating the rigid plate 504 are particularly suited to higher heat flux heat exchangers that are not impacted by the larger pressure drop. For example, on a power laser diode, energy from the power laser diode may be concentrated in a 50×50 micrometer surface. Likewise, on a central processor unit (CPU), the locations of each core of a multi-core processor may present high heat flux dissipation requirements. Locating a heat exchanger with the active vortex generator including the flag 404 with the rigid portion 406 or oscillating the rigid plate 504 proximate to such high heat flux dissipation locations provides for improved heat transfer that can be activated when needed (e.g., upon operation of the power laser diode or a corresponding core of a multi-core processor).

Likewise, because the oscillating normal flag 302 results in a substantial increase in heat transfer while at the same time limiting the pressure drop across the heat exchanger 300, the oscillating normal flag 302 is suited to implementations that are more sensitive to pressure drops. For example, the oscillating normal flag 302 may be more suited for inclusion at the inlet of a tube-in-tube heat exchanger. Other implementations are contemplated by this disclosure.

FIGS. 15-18 are views of an implementation of a heat exchanger 1500 with an active vortex generator 1502 comprising an oscillating normal flag 1504. The heat exchanger 1500 comprises a cooling fluid channel 1506. As shown, the fluid channel 1506 comprises a top surface 1508, a bottom surface 1510, a first side surface 1512, and a second side surface 1514. The first and second side surfaces 1512 extend between the top and bottom surfaces 1508, 1510 to enclose the fluid channel 1506. The bottom surface 1510 is in contact with a heat source which imparts a heat flux 1516. In the example shown, the heat flux 1516 leads to two-phase heat exchange as indicated by the presence of the bubble 1518.

The active vortex generator 1502 comprises a first actuator 1520 and a second actuator 1522 positioned about the first and second side surfaces 1512, 1514, respectively. The first actuator 1520 comprises a first solenoid 1524 coupled to a first drive arm 1526. Likewise, the second actuator 1522 comprises a second solenoid 1528 coupled to a second drive arm 1530. The first drive arm 1526 comprises a linkage 1532 that is affixed to a first end of an anchor 1534 for the flag 1504. In the example shown, the anchor 1534 is a rod, though other rigid support structures are contemplated by this disclosure, such as a bar, tube, beam or any other sufficiently rigid support structure to anchor the flag 1504 in the fluid channel 1506. The second drive arm 1530 likewise comprises a linkage 1536 that is affixed to a second end of the anchor 1534. Following the example of FIG. 3 above, the flag 1504 is coupled to the anchor 1534 at a rotatable joint and the flag 1504 is adapted to move freely within a cooling fluid passing through the fluid channel 1506.

The anchor 1534 passes through a first aperture 1538 in the first side surface 1512 and a second aperture 1540 in the second side surface 1514. A first seal 1542 is positioned within the first side surface 1512 and around the anchor 1534 to prevent the cooling fluid from escaping from the fluid channel 1506 through the first aperture 1538. Likewise, a second seal 1544 is positioned within the second side surface 1514 and around the anchor 1534 to prevent the cooling fluid from escaping from the fluid channel 1506 through the second aperture 1540. The first and second seals 1542, 1544 are larger than the first and second apertures 1538, 1540 and extend within the first and second side surfaces 1512, 1514 beyond the first and second apertures 1538, 1540.

In operation, the solenoids 1524, 1528 are instructed by a controller (not shown) to move the drive arms 1526, 1530 in and out between a first position and a second position and thereby move the anchor 1534 along an oscillation path, as discussed above. As the anchor 1534 moves within the apertures 1538, 1540, the first and second seals 1542, 1544 move within the first and second side surfaces 1512, 1514 to continue to prevent cooling fluid from escaping from the fluid channel 1506 through the apertures 1538, 1540. Additionally, as the anchor 1534 moves along the oscillation path, the flag 1504 waves within the cooling fluid to generate the vortices 114, as described above.

In an example, a length of the flag 1504 is between 0.5-2.5 mm. A width of the flag 1504 is substantially the same dimension as the length of the flag 1504. The width of the fluid channel 1506 is 2-3 times the length of the flag 1504 (e.g., 1-7.5 mm). A thickness of the flag 1504 is less than 0.05 times the length of the flag 1504. An amplitude of the oscillation of the anchor 1534 along the oscillation path is 0.5-1 times the length of the flag 1504. The actuators 1520, 1522 are configured to oscillate the anchor 1534 along the oscillation path at a frequency of 0.05-0.2 seconds.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A heat exchanger, comprising:

an enclosed cooling fluid channel comprising a heat transfer surface, the cooling fluid channel adapted to receive a flow of a liquid cooling fluid along a length of the cooling fluid channel;

an anchor extending across the cooling fluid channel in a direction perpendicular to the length of the cooling fluid channel and parallel to the heat transfer surface;

an active vortex generator affixed to the anchor and configured to extend in a direction parallel to the heat transfer surface; and an actuator coupled to the anchor and configured to move the anchor along an oscillation path within the cooling fluid channel, wherein the oscillation path within the cooling fluid channel is perpendicular to the heat transfer surface and is closer to the heat transfer surface than a surface of the cooling fluid channel opposite to the heat transfer surface such that vortices generated by the active vortex generator are produced in a thermal boundary layer along the heat transfer surface, wherein at least a portion of a length of the active vortex generator is sufficiently rigid to resist induced generation of vortices due the flow of the liquid cooling fluid, but sufficiently flexible that motion of the anchor along the oscillation path produces a vortex.

2. The heat exchanger of claim 1, wherein the anchor is a rod, bar, tube, or beam.

3. The heat exchanger of claim 1, wherein the active vortex generator comprises a flexible sheet of material selected from a group of flexible materials consisting of a metal plate, a polymeric plate, and a textile sheet.

4. The heat exchanger of claim 3, wherein a leading edge of the flexible sheet of material is affixed to the anchor as a rotatable joint and a trailing edge of the flexible sheet of material is free to move within the cooling fluid channel.

5. The heat exchanger of claim 1, wherein the active vortex generator comprises a sheet of material with a rigid portion and a flexible portion.

6. The heat exchanger of claim 5, wherein a leading edge of the sheet of material comprises the rigid portion and a trailing edge of the sheet of material comprises the flexible portion.

7. The heat exchanger of claim 6, wherein the leading edge of the sheet of material is affixed to the anchor as a rigid joint and the trailing edge of the sheet of material is free to move within the cooling fluid channel.

8. The heat exchanger of claim 1, wherein the active vortex generator comprises a rigid sheet of material affixed to the anchor as a rigid joint.

9. The heat exchanger of claim 1, wherein the active vortex generator is configured to extend in a direction counter to the flow of the liquid cooling fluid in the cooling fluid channel.

10. The heat exchanger of claim 1, wherein the active vortex generator comprises a sheet of material with the length between 0.5-2.5 mm.

11. The heat exchanger of claim 10, wherein a width of the sheet of material is substantially the same dimension as the length of the sheet of material.

12. The heat exchanger of claim 10, wherein a width of the cooling fluid channel is 2-3 times the length of the sheet of material.

13. The heat exchanger of claim 10, wherein a thickness of the sheet of material is less than 0.05 times the length of the sheet of material.

14. The heat exchanger of claim 1, wherein the actuator is coupled to a first end of the anchor, the heat exchanger further comprising:

a second actuator coupled to a second end of the anchor and configured to move the anchor along the oscillation path.

15. The heat exchanger of claim 1, wherein the actuator is configured to move the anchor along the oscillation path at a frequency of 0.05-0.2 seconds.

16. An active vortex generator for a heat exchanger, comprising:

an anchor coupled across an enclosed fluid channel parallel to a heat transfer surface in the fluid channel, wherein the anchor is perpendicular to a flow of a liquid cooling fluid within the fluid channel;

the active vortex generator is affixed to the anchor and extends in a direction parallel to the heat transfer surface; and an actuator coupled to the anchor and adapted to move the anchor along an oscillation path within the flow of the liquid cooling fluid within the fluid channel, wherein the oscillation path within the fluid channel is perpendicular to the heat transfer surface and is closer to the heat transfer surface than a surface of the fluid channel opposite to the heat transfer surface such that vortices generated by the active vortex generator are produced in a thermal boundary layer along the heat transfer surface, wherein at least a portion of a length of the active vortex generator is sufficiently rigid to resist induced generation of vortices due the flow of the liquid cooling fluid, but sufficiently flexible that motion of the anchor along the oscillation path produces a vortex.

17. The heat exchanger of claim 1, wherein the active vortex generator is positioned proximate to a high heat flux dissipation location with two-phase heat transfer.

18. The heat exchange of claim 1, wherein the actuator manipulates a frequency at which the anchor travels along the oscillation path to produce a desired amount of vortices.

19. The active vortex generator of claim 16, wherein the actuator is coupled to a first end of the anchor, the active vortex generator further comprising:

a second actuator coupled to a second end of the anchor and configured to move the anchor along the oscillation path.

20. The active vortex generator of claim 16, wherein the actuator is configured to move the anchor along the oscillation path at a frequency of 0.05-0.2 seconds.

* * * * *